US007021990B2

(12) United States Patent
Montandon et al.

(10) Patent No.: US 7,021,990 B2
(45) Date of Patent: Apr. 4, 2006

(54) METHOD AND APPARATUS FOR CIRCULAR GRINDING

(75) Inventors: Jean-Claude Montandon, Arch (CH); Herman Ingold, Hessigkofen (CH)

(73) Assignee: HTT Hauser Tripet Tschudin AG, Biel-Bienne (CH)

( * ) Notice: Subject to any disclaimer, the term of this patent is extended or adjusted under 35 U.S.C. 154(b) by 0 days.

(21) Appl. No.: 10/919,444

(22) Filed: Aug. 17, 2004

(65) Prior Publication Data

US 2005/0079799 A1 Apr. 14, 2005

(30) Foreign Application Priority Data

Aug. 19, 2003 (EP) ..... 03405603

(51) Int. Cl.
*B49D 1/00* (2006.01)

(52) U.S. Cl. ..... 451/5; 451/49; 451/57; 451/177; 451/189; 451/190; 451/194; 451/223; 451/261; 451/262

(58) Field of Classification Search ..... 451/5, 451/49, 57, 177, 189, 190, 194, 223, 261, 451/262

See application file for complete search history.

(56) References Cited

U.S. PATENT DOCUMENTS 4,439,951 A * 4/1984 Oppelt et al. ..... 451/194
5,228,241 A * 7/1993 Ohta et al. ..... 451/5
6,283,837 B1 * 9/2001 Vorbuchner ..... 451/58

FOREIGN PATENT DOCUMENTS

| | | | |
|---|---|---|---|
| DE | 10126796 | A1 | 12/2002 |
| JP | 10-128647 | A | 5/1998 |
| WO | WO-99/32258 | A1 | 7/1999 |
| WO | WO-99/42248 | A1 | 8/1999 |
| WO | WO-01/60565 | A1 | 8/2001 |

* cited by examiner

*Primary Examiner*—Lee D. Wilson
*Assistant Examiner*—Shantese L. McDonald
(74) *Attorney, Agent, or Firm*—Birch, Stewart, Kolasch & Birch, LLP

(57) ABSTRACT

A method and apparatus for a circular grinding of a workpiece having first and second workpiece faces which are rotationally symmetrical with respect to the workpiece axis and which form a circular transition edge between them are provided. The workpiece rotating about its axis and a grinding wheel rotating about a grinding-wheel axis are advanced towards one another. During grinding, an auxiliary abrasive tool, which rotates about an auxiliary-tool axis and has a plane abrasive surface arranged at right angles to the auxiliary-tool axis, is pressed against the workpiece in such a way that the abrasive surface is arranged in a tangential plane to the second workpiece face and touches the second workpiece face along a contact line. The plane abrasive surface projects in the direction of the contact line away from the second workpiece face beyond the transition edge.

12 Claims, 3 Drawing Sheets

METHOD AND APPARATUS FOR CIRCULAR GRINDING

BACKGROUND OF THE INVENTION

1. Field of the Invention

The invention relates to a method for a circular grinding of a workpiece and to an apparatus for carrying out the circular grinding method.

2. Background of the Invention

Many applications require workpieces which are at least partially of rotationally symmetrical design and have a workpiece axis defining the axis of symmetry and also two adjacent faces which are designed to be rotationally symmetrical with respect to the workpiece axis and between which is formed a circular transition edge. Such workpieces are used, for example, as valve needles or nozzle needles, typically one of the two faces forming a sealing seat and the other of the two faces forming a guide face on the valve needle or nozzle needle. So that such valve needles or nozzle needles can be used even for high-pressure applications, such as, for example, fuel injection systems for modern petrol or diesel engines, where sometimes pressures of well above 1000 bar have to be controlled, high requirements must be satisfied in terms of adherence to manufacturing tolerances. In particular, the transition edge between the seat face and the guide face must be formed so as to be as sharp-edged and as burr-free as possible.

Workpieces of the abovementioned type are machined using circular grinding by using circular grinding machines for carrying out the circular grinding methods.

The publication WO 01/60565 (Robert Bosch GmbH) disclosures a circular grinding method and a circular grinding machine which makes it possible to produce a valve needle for a fuel injection valve by means of circular grinding. The circular grinding machine is provided with a grinding wheel and with a deburring mandrel arranged opposite the grinding wheel with respect to the workpiece. When the grinding wheel grinds a grinding face of the workpiece, a burr occurs, which projects beyond the transition edge formed between this grinding face and an adjacent face into the region of the adjacent face. The deburring mandrel is arranged and designed in such a way that the burr is pressed back onto the grinding face by the deburring mandrel as a result of the rotation of the workpiece rotating about its axis and is ground down during the next contact with the grinding wheel.

It became apparent that the circular grinding method and the circular grinding machine according to the publication WO 01/60565 have disadvantages in terms of the mass production of large workpiece series. To be precise, it repeatedly happens that burr formation is not reliably prevented by the deburring mandrel. A complicated rechecking of the workpieces is therefore necessary so that the desired manufacturing quality can be ensured.

SUMMARY OF THE INVENTION

The present invention provides a method and an apparatus for circular grinding which allow a reliable and accurate machining of workpieces with a sharp and burr-free transition edge between two rotationally symmetrical faces, even in the manufacture of large series.

The solution to the object is defined by the features of the independent patent claims. According to the invention, in order to machine a workpiece, which has a workpiece axis, a circular grinding method is carried out. While the circular grinding method is being carried out, the workpiece rotates about the workpiece axis, whilst at the same time a grinding wheel rotating about a grinding wheel axis and the workpiece are advanced towards one another, in order in one grinding operation to grind a first workpiece face which is designed to be rotationally symmetrical with respect to the workpiece axis. The workpiece has a second workpiece face which is designed to be rotationally symmetrical with respect to the workpiece axis and which is defined by a rectilinear generatix. The two workpiece faces are arranged adjacent to one another in such a way that a sharp circular transition edge is formed between them. The circular grinding method according to the invention is distinguished in that an auxiliary abrasive tool, which rotates about an auxiliary-tool axis and has a plane abrasive surface arranged at right angles (that is to say, normally) to the auxiliary-tool axis, is pressed against the workpiece. The auxiliary abrasive tool is pressed against the workpiece in such a way that the abrasive surface is arranged in a tangential plane to the second workpiece face (that is to say, in a tangential plane lying on the second workpiece face) and, in a portion of the second workpiece face which is contiguous to the transition edge, touches this second workpiece face along a straight contact line. In this case, the abrasive surface projects in the direction of the contact line away from the second workpiece face beyond the transition edge.

By virtue of the grinding method according to the invention, a burr which possibly occurs during the grinding of the first workpiece face and which projects beyond the transition edge into the region above the second workpiece face is removed by the auxiliary abrasive tool or by its abrasive surface, so that a sharp and burr-free transition edge between the first and the second workpiece face is formed.

The second workpiece face is designed to be rotationally symmetrical with respect to the workpiece axis, the second workpiece face being defined in geometric terms by a rectilinear generatrix which is rotated about the workpiece axis. That is to say, the second workpiece face is in the form either of a conical face or of a surface area of a straight circular cylinder. The result of this is that a tangential plane (and therefore also the abrasive surface of the auxiliary abrasive tool) resting on the second workpiece face does not touch the second workpiece face merely at one point, but along a straight contact line. Consequently, the abrasive surface, when it is pressed against the second workpiece face and is rotated about the auxiliary-tool axis, is not worn away linearly, but two-dimensionally, and thereby preserves its plane surface shape.

The first workpiece face may likewise be designed conically or in the form of the surface area of the circular cylinder. As an alternative to this, however, it may also be designed to be rotationally symmetrical with respect to the first workpiece axis in another way, in which case it is defined by a curved generatrix.

For carrying out the grinding method according to the invention, it is possible for the workpiece to be rotated about a workpiece axis stationary during the grinding operation and for the grinding wheel to be advanced towards the workpiece. Such grinding operations are typically carried out on circular grinding machines, in which an elongate workpiece is received between a workpiece spindle mounted on a spindle headstock stationary during the grinding operation and a sleeve arranged on a tailstock stationary during the grinding operation. As an alternative to this, however, it is also possible for the workpiece rotating about the workpiece axis to be advanced towards a grinding wheel rotating about a grinding-wheel axis stationary during the grinding operation. Such grinding operations are executed, as a rule, by circular grinding machines which are designed for centreless circular grinding (that is to say, for circular grinding without a sleeve). Moreover, it is also possible, in principle, for both the grinding wheel and the workpiece axis (or a workpiece spindle defining the workpiece axis) to be moved simultaneously while the grinding operation is being carried out.

Preferably, the pressing of the auxiliary abrasive tool against the workpiece and the grinding of the first workpiece face are terminated at the same time. Since the two abrasive operations (that is to say, the grinding operation between the grinding wheel and the first workpiece face, on the one hand, and the abrasive operation between the auxiliary abrasive tool and the second workpiece face, on the other hand) are executed simultaneously and terminated at the same time at least to the end of the method according to the invention, no burr of any kind is left behind at the transition edge. The term "at the same time" means, in the present context, that a possible time difference between the end of the first and of the second abrasive operation is too short for burr formation, even when, during a period corresponding to this time difference, only one of the two abrasive tools is in (grinding) contact with the workpiece.

However, terminating the pressing of the auxiliary abrasive tool against the workpiece and the grinding of the first workpiece face at the same time is not absolutely necessary for a functioning of the present invention. Particularly in the case where the auxiliary abrasive tool, while being pressed with the abrasive surface against the second workpiece face, machines the second workpiece face with a substantially lower grinding power than the grinding power with which the grinding wheel at the same time machines the first workpiece face, the pressing of the auxiliary abrasive tool may also be terminated later than the grinding, because, in this case, the pressing of the auxiliary abrasive tool results in virtually no burr formation.

A circular grinding apparatus according to the invention, which is designed particularly for carrying out the method according to the invention, comprises a workpiece spindle which rotates about a workpiece-spindle axis and which is provided with a workpiece holder designed for receiving a workpiece. The circular grinding apparatus further comprises a grinding wheel rotating about a grinding-wheel axis and a first advancing device. The first advancing device is designed in such a way that, by means of the first advancing device, either the grinding wheel can be advanced towards the workpiece or the workpiece, together with the workpiece spindle, can be advanced towards the grinding wheel. Both the grinding wheel and the workpiece, together with the workpiece spindle, may, however, also be movable at the same time with respect to a stationary base, in order to advance the grinding wheel and the workpiece towards one another. The circular grinding apparatus according to the invention further comprises an auxiliary abrasive tool which rotates about an auxiliary-tool axis and which has a plane abrasive surface arranged at right angles to the auxiliary-tool axis. The circular grinding apparatus according to the invention further comprises a second advancing device which is designed for advancing the auxiliary abrasive tool towards the workpiece, and also a control device for controlling the circular grinding apparatus.

The control device is designed for controlling the first advancing device in such a way that the grinding wheel and the workpiece are advanced towards one another, in order to machine a first workpiece face in one grinding operation. The control device is designed, further, for controlling the second advancing device in such a way that, while the grinding operation is being carried out, the auxiliary abrasive tool is advanced towards the workpiece by means of the second advancing device, so that it presses its abrasive surface against the second workpiece face. The two workpiece faces are designed to be rotationally symmetrical with respect to the workpiece-spindle axis, and the second workpiece face is defined by a rectilinear generatrix. Further, the two workpiece faces are arranged adjacent to one another in such a way that a circular transition edge is formed between them. The control device and the second advancing device are designed, further, in such a way that, when the abrasive surface presses against the second workpiece face, the abrasive surface is arranged in a tangential plane to the second workpiece face, touches the second workpiece face along a contact line and projects in the direction of the contact line away from the second workpiece face beyond the transition edge.

Since the abrasive surface, in the arrangement touching the second workpiece face, projects away from the second workpiece face beyond the transition edge, during the simultaneous rotation of the workpiece about the workpiece-spindle axis and of the auxiliary abrasive tool about the auxiliary-tool axis, a burr which possibly occurs during the grinding of the first workpiece face and which projects beyond the transition edge into the region above the second workpiece face is removed by the auxiliary abrasive tool or by its abrasive surface, so that a sharp and burr-free transition edge between the first and the second workpiece face is formed.

According to an embodiment of the invention, at least one portion of the auxiliary abrasive tool is of cylindrical (also designated as pin-shaped) design, the abrasive surface being the cylinder base area. The entire auxiliary abrasive tool may also have an overall cylinder- or pin-shaped design. The pin-shaped portion of the auxiliary abrasive tool may, in particular, be in the form of a straight circular cylinder, with a base area or abrasive surface in the form of a circular face. In principle, however, other shapes of auxiliary abrasive tools are also possible, for example an auxiliary abrasive tool of hollow-cylindrical design with an annularly designed abrasive surface, or an auxiliary abrasive tool of parallelepipedal design with a rectangular or square abrasive surface.

Preferably, the auxiliary abrasive tool is designed in such a way and, while being pressed against the second workpiece face, is arranged in such a way that the contact line on the abrasive surface extends as an uninterrupted line from an outer margin of the abrasive surface, along a diameter leading through the auxiliary-tool axis (or through the prolongation of the latter), beyond the auxiliary-tool axis (or the prolongation of the latter) as far as the transition edge. In the present context, an axis is always understood to mean an axis in the geometric sense. The contact line on the abrasive surface thus extends as an uninterrupted line from an outer margin of the abrasive surface, along a diameter leading through the (mechanical) auxiliary-tool axis or the prolongation of the latter, beyond the (mechanical) auxiliary-tool axis or the prolongation of the latter as far as the transition edge. As a result, when, while the abrasive surface is being pressed against the second workpiece face, the auxiliary abrasive tool is at the same time rotated about the auxiliary-tool axis, the entire abrasive surface is worn away. The result of this is that the abrasive surface remains essentially plane while being worn away, the consequence of this being that an undesirable rounding of the transition edge is avoided. Preferably, the abrasive surface projects only with a small fractional area beyond the transition edge, in order to ensure as uniform a wear of the abrasive surface as possible. Thus, for example, the contact line between the abrasive surface and the second workpiece face may measure more than two thirds, preferably more than three quarters, particularly even more than four fifths of the abrasive surface diameter leading through the auxiliary-tool axis.

According to a further advantageous embodiment of the invention, while the auxiliary abrasive tool is being pressed against the second workpiece face, the workpiece is made to rotate about the workpiece-spindle axis in such a way and the auxiliary abrasive tool is made to rotate about the auxiliary-tool axis in such a way that the auxiliary abrasive tool (or the abrasive surface) has, in the region of the intersection point of the contact line with the transition edge, a speed component opposite to the direction of the speed of the workpiece in this region. In other words, the direction of rotation of the workpiece with respect to the workpiece-spindle axis and the direction of rotation of the auxiliary abrasive tool with respect to the auxiliary-tool axis are selected such that, in the region of the transition edge, where the abrasive surface touches the second workpiece face, the abrasive surface has a speed component directed opposite to the speed of the workpiece. As a result, in this region, a high relative speed between the abrasive surface and the workpiece is achieved, thus bringing about an efficient removal of the burr produced by the grinding wheel and thus leading to an efficient prevention of burr formation at the transition edge of the workpiece.

The auxiliary abrasive tool of the circular grinding apparatus according to the invention may comprise a honing pin or a precision-grinding stone (also designated as a degussite stone, superfinish stone, polishing stone or whetstone) which is provided with the abrasive surface. In this case, the abrasive surface is preferably designed as the end face of the honing pin or of the precision-grinding stone.

The apparatus according to the invention may comprise, further, a conditioning tool for the conditioning (also designated as truing) of the abrasive surface of the auxiliary abrasive tool. Such a conditioning tool may be part of a conditioning device designed specifically for conditioning the abrasive surface (that is to say, separate). As an alternative to a specific conditioning device, however, the conditioning tool may also be merely a tool which is provided with hard surface and which, for the purpose of conditioning, is received in the manner of a workpiece on the workpiece spindle, whereupon the auxiliary abrasive tool rotating about the auxiliary-tool axis is advanced towards the conditioning tool rotating about the workpiece-spindle axis, in order to bring about the conditioning of the abrasive surface of the auxiliary abrasive tool. Such a conditioning tool may, in particular, have a shape which is identical to the shape of the workpieces to be machined by means of the circular grinding apparatus. As an alternative to the use of a conditioning tool however, an auxiliary abrasive tool may also be used, the abrasive surface of which is manufactured from a material which, during the operation of the circular grinding apparatus, wears away in such a way that no conditioning is required. Such a material may be, for example, a material customary for the production of honing tools, in particular honing pins.

Advantageously, the circular grinding apparatus according to the invention further comprises means for the selective setting of the force with which the auxiliary abrasive tool presses against the second workpiece face. This affords the possibility of adapting the pressure with which the abrasive surface presses against the second workpiece face to the burr formation to be expected during grinding by means of the grinding wheel. Advantageously, the force or pressure is kept as low as possible, so that a burr possibly occurring during grinding is just removed, but without the dimensions of the second workpiece face at the same time being modified appreciably as a result of machining by means of the auxiliary abrasive tool.

Advantageously, the circular grinding apparatus according to the invention is designed in such a way that the auxiliary abrasive tool, while being pressed with the abrasive surface against the second workpiece face, machines the second workpiece face with a substantially lower grinding power than the grinding power with which the grinding wheel at the same time machines the first workpiece face. Grinding power is understood, in the present context, to mean the power per unit area which is generally defined for workpiece cutting machining which has the physical unit [area/time unit]. The ratio of the grinding power of the auxiliary abrasive tool to the grinding power of the grinding wheel corresponds, as a rule, to the ratio of the installed maximum power which the spindle drive of the auxiliary abrasive tool can deliver during the machining of the second workpiece face to the installed maximum power which the spindle drive of the grinding wheel can deliver during the grinding of the first workpiece face. Since the grinding power of the auxiliary abrasive tool is substantially lower than that of the grinding wheel during the grinding of the first workpiece face, the dimension of the second workpiece face which may have already been ground to the desired dimension with high precision in a preceding grinding operation remains essentially unchanged while the grinding method according to the invention is being carried out. The grinding power of the auxiliary abrasive tool may amount to less than 1%, preferably less than 0.5%, in particular even less than 0.1% of the grinding power of the grinding wheel.

According to a third preferred variant of the invention, the auxiliary abrasive tool is arranged on what may be referred to as a measuring instrument platform which is movable with respect to the workpiece spindle and which is equipped with at least one measuring instrument. The second advancing device, which serves for advancing the auxiliary abrasive tool towards the workpiece, may then be formed by the movement or motion device with the movement or motion of the measuring instrument platform. If only a single motion device is used for the advance or motion of the auxiliary abrasive tool, on the one hand, and for the movement or motion of the measuring instrument platform, on the other hand, a simple cost-effective design of the circular grinding apparatus is obtained. As an alternative to being arranged on a measuring instrument platform, the auxiliary abrasive tool may also be arranged on another part of the circular grinding apparatus, for example on a tailstock sleeve, the said part being movable with respect to a stationary machine. As a further alternative, the second advancing device may also be designed as a separate motion device which serves solely for the advance of the auxiliary abtrasive tool towards the workpiece.

According to a further advantageous aspect of the invention, the auxiliary abrasive tool, while being pressed against the second workpiece face, is arranged on a side of the workpiece which faces away from the grinding wheel. The abrasive surface of the auxiliary abrasive tool and the grinding wheel then press at the same time onto the workpiece in opposite directions from two opposite sides. This results in an additional stabilization of the workpiece during the grinding operation, and this may contribute to increasing the precision during grinding.

Further advantageous embodiments and further combinations of the invention may be gathered from the following detailed description and from the patent claims taken as a whole.

BRIEF DESCRIPTION OF THE DRAWINGS

In the drawings used for explaining the exemplary embodiments.

Identical parts are basically given the same reference in all the Figures.

DETAILED DESCRIPTION OF THE PRESENT INVENTION

Figure 1:
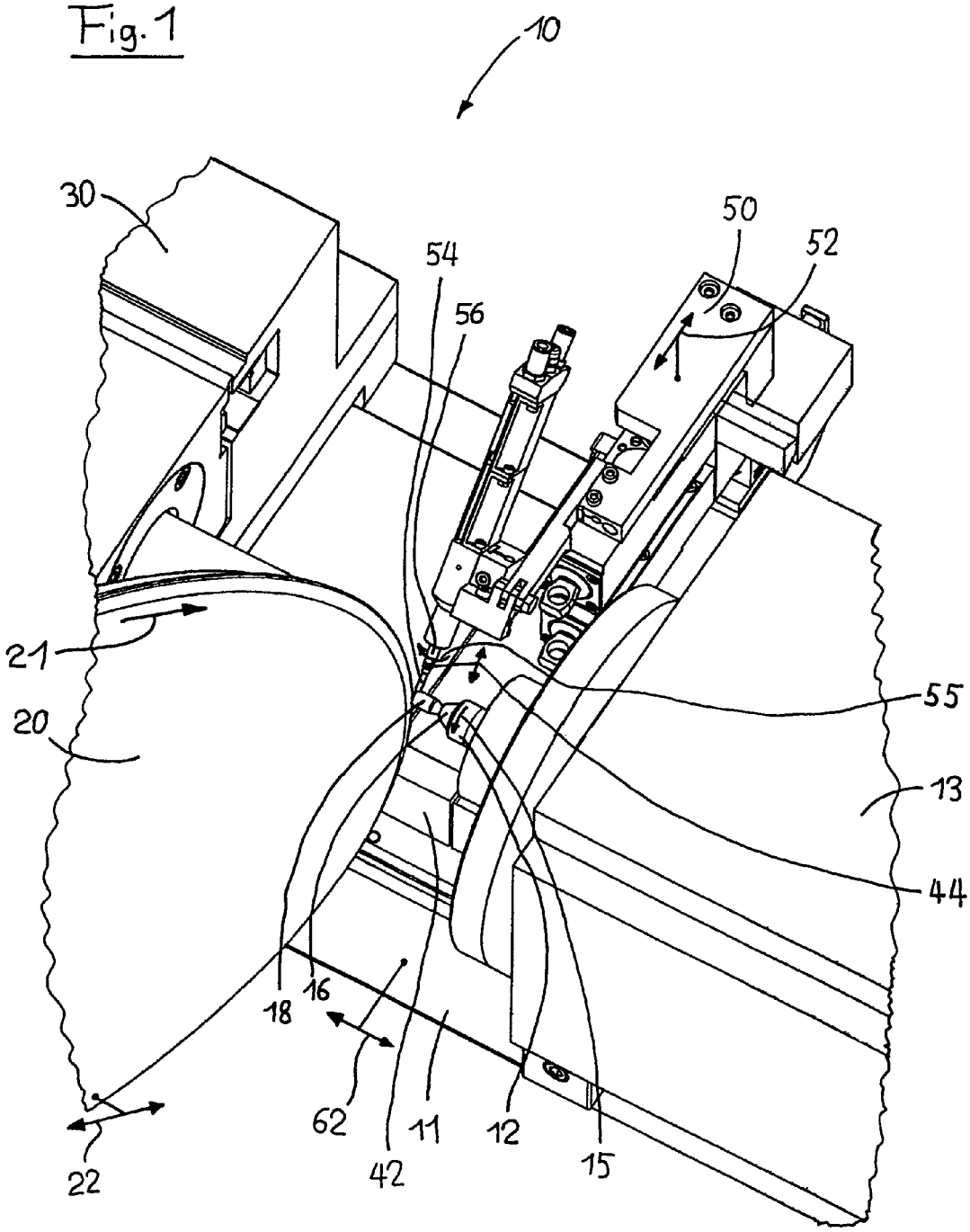
FIG. 1 shows a simplified part-view, obliquely from above, of a circular grinding apparatus according to a first preferred embodiment of the invention, in a first working position.
Figure 2:
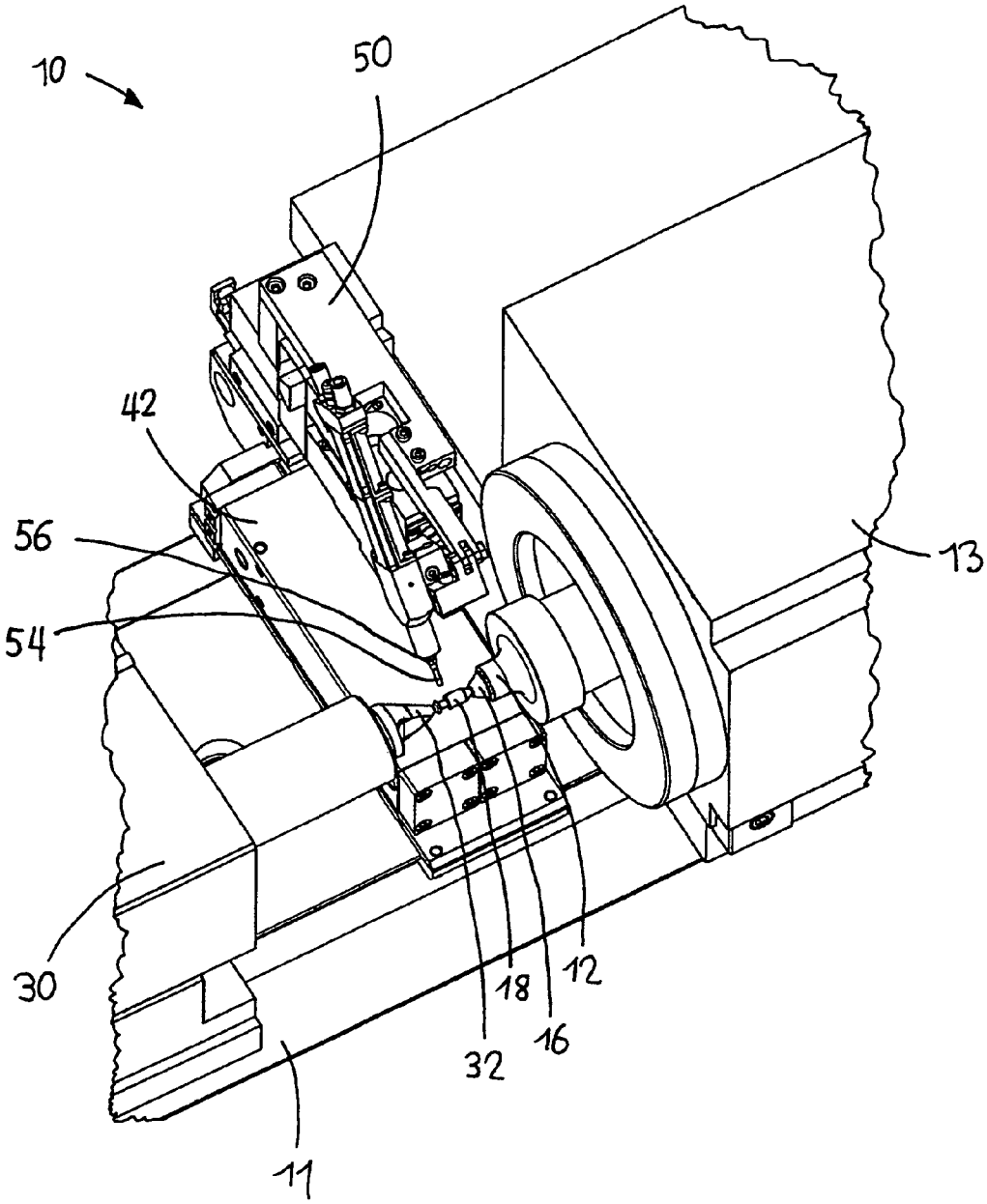
FIG. 2 show the circular grinding apparatus from FIG. 1 in a second working position, in a simplified part-view obliquely from above.

FIGS. 1 and 2 illustrate a cylindrical surface grinding machine 10 which has a stable stationary machine bed (not illustrated). On the machine bed is arranged a straight linear guide (not illustrated) which is designated below as first linear guide. A slide 11, designated below as first slide 11, is movable rectilinearly on the first linear guide, as indicated in FIG. 1 by the double arrow 62.

Arranged fixedly on the first slide 11 is a workpiece-spindle headstock 13, in which workpiece spindle 12 is mounted rotatably about an essentially horizontal workpiece-spindle axis (not illustrated), the workpiece-spindle axis extending parallel to the direction of movement of the first slide 11 on the first linear guide (that is to say, parallel to the first linear guide). Arranged at an overhung end of workpiece spindle 12 is a workpiece clamping device 16 in which a longitudinal end of an elongate workpiece 18 is clamped. The workpiece spindle 12 is driven by a motor (not illustrated) in such a way that, during grinding, the said workpiece spindle rotates at a rotational speed of approximately 800 rev/min about the workpiece-spindle axis, as indicated by the arrow 15 in FIG. 1.

The machine bed has arranged on it a further straight linear guide (not illustrated) which is designated below as second linear guide. A slide (not illustrated), designated below as a second slide, is movable essentially horizontally along the second linear guide obliquely to the workpiece spindle axis. The second slide carries the grinding-spindle headstock (not illustrated) of the circular surface grinding machine 10, a grinding wheel 20 being mounted rotatably about an essentially horizontal grinding-wheel axis (not illustrated) in the grinding-spindle headstock. The second slide and the second linear guide are part of a first advancing device which serves for advancing the grinding wheel 20 towards the workpiece 18 and for moving it away from the latter again, as indicated by the double arrow 22 in FIG. 1.

The circular surface grinding machine 10 illustrated in FIGS. 1 and 2 is provided with a machine control which is designed for controlling all the components of the circular surface grinding machine 10 and, in particular, also controlling the first advancing device and the second advancing device which is further described below.

Further, a tailstock 30 is mounted fixedly, opposite the workpiece-spindle headstock 13, on the first slide. A sleeve 32 projecting in the direction of the workpiece-spindle headstock 13 is arranged on that end face of the tailstock 30 which faces the workpiece-spindle headstock 13, this sleeve 32 being movable, parallel to the workpiece-spindle axis, with respect to the tailstock 30 by means of a hydraulic drive (not illustrated).

The workpiece spindle 12 and the sleeve 32 are arranged in such a way that the workpiece 18 clamped at one longitudinal end on the workpiece clamping device 16 is received between the workpiece spindle 12 and the sleeve 32, the said workpiece being stabilized, during its rotation about the workpiece-spindle axis, at the other longitudinal end by the sleeve centre. Moreover, the tailstock 30, workpiece-spindle headstock 13 and the grinding-spindle headstock movable on the second linear guide are arranged with respect to one another in such a way that the grinding wheel 20 can be advanced towards the workpiece 18 between the workpiece spindle 12 and the sleeve centre by means of the first advancing device.

A grinding wheel 20 is designed for grinding a conical outer face of the workpiece 18, the said outer face being designed to be rotationally symmetrical with respect to the workpiece-spindle axis. The workpiece 18 has, further, an outer face of circular-cylindrical design, which is likewise designed to be rotationally symmetrical with respect to the workpiece-spindle axis. The two workpiece faces are arranged adjacently to one another in such a way that a circular transition edge is formed between them, the workpiece having a diameter of approximately 4 mm in the region of the cylindrical outer face (and therefore in the region of the transition edge). The grinding wheel 20 has a wheel diameter of approximately 500 mm and is driven by a motor (not illustrated) in such a way that the said grinding wheel, during grinding, rotates at a rotational speed of approximately 1750 rev/min about the grinding-wheel axis. In this case, as indicated by the arrow 21 in FIG. 1, the direction of rotation of the grinding wheel 20 selected such that the speed of the grinding wheel 20 in the region where the grinding wheel 20 touches the workpiece 18 is directed opposite to the speed of the workpiece 18 as a result of the rotation of the latter about the workpiece-spindle axis in this region.

Further, a measuring platform plinth 42 is arranged fixedly on the first slide 11 in the region between the workpiece-spindle headstock 13 and the tailstock 30. On the measuring platform plinth 42 is arranged a third slide 50 which is movable along a third linear guide at right angles to the workpiece-spindle axis and essentially horizontally with respect to the measuring platform plinth 42, as indicated by the double arrow 52 in FIG. 1. The third slide 50 serves as a measuring platform 50 carrying a measuring instrument which is designed for measuring, inter alia, the diameter of the workpiece 18 machined by means of the grinding wheel 20, so that a measurement-controlled grinding operation can be carried out.

The measuring platform plinth 42 and the third slide 50 and also the third linear guide are part of a measuring platform positioning device which serves to move the measuring platform 50 towards the workpiece 18 and away from it again. In this case, the measuring platform positioning device is designed and arranged in such a way that the third slide 50 or the measuring platform 50 is arranged on that side of the workpiece 18 which is located opposite the grinding wheel 20 with respect to the workpiece 18.

Further, the third slide 50 or the measuring platform 50 has arranged on it an auxiliary spindle 56 which is mounted rotatably with respect to the third slide 50 about an auxiliary-spindle axis arranged at right angles to the workpiece-spindle axis and inclined obliquely downwards. Arranged at an overhung end of the auxiliary spindle 56 is a honing-pin clamping device, in which is clamped one longitudinal end of an elongate honing pin 54 which is essentially in the form of a straight circular cylinder, the cylinder axis of the honing pin 54 being arranged coaxially to the auxiliary-spindle axis. The cylinder base area, remote from the auxiliary spindle, of the cylindrical honing pin 54 forms the abrasive surface or the honing surface of the honing pin 54.

The auxiliary spindle 56, together with the honing pin 54, is movable rectilinearly in the direction of the auxiliary-spindle axis with respect to the third slide 50 by means of a pneumatic drive, as indicated by the double arrow 44 in FIG. 1. This pneumatic drive and also the measuring platform positioning device formed from the measuring platform plinth 42 and from the third slide 50 are part of a second advancing device serves to advance the honing pin 54 towards the workpiece 18 in such a way that its honing surface presses against the cylindrical outer face of the workpiece 18. In the circular surface grinding machine 10 illustrated in FIGS. 1 and 2, the second advancing device is designed and arranged in such a way that the honing pin 54 is pressed against the cylindrical outer face of the workpiece 18 obliquely from above on that side of the workpiece 18 which is located opposite the grinding wheel 20 with respect to the said workpiece, whilst at the same time the grinding wheel is advanced essentially horizontally towards the workpiece 18 by the first advancing device, in order to grind the conical outer face of the workpiece 18. Further, the pneumatic drive for moving the auxiliary spindle 56 can be actuated by the machine control in such a way that this drive presses the honing pin against the workpiece 18 via the auxiliary spindle 56 with a force set specifically according to the application. This application-specific force can be set manually by an operator at a suitable setting device for a series of grinding processes (that is to say, for one application) during this setting of the circular surface grinding machine 10.

The honing pin 54 has a diameter of between approximately 1 and 2 mm. The auxiliary spindle 56 (and, with it, the honing pin 54) is driven by a motor (not illustrated) in such a way that, during honing, the said auxiliary spindle rotates at a rotational speed of between approximately 50 and 100 rev/min about the auxiliary-spindle axis. In this case, as indicated by the arrow 55 in FIG. 1, the direction of rotation of the auxiliary spindle 56 is selected such that, when the honing surface touches the workpiece 18 in the region of the transition edge formed between the conical and the cylindrical workpiece surfaces, the honing pin (or the honing surface) has in the region of the intersection point of the contact line with the transition edge a speed component opposite to the direction of the speed of workpiece 18 (as a result of the rotation of workpiece 18 about the workpiece-spindle axis) in this region.

FIG. 1 shows the circular surface grinding machine 10 in a working position in which both the grinding wheel 20 and the honing pin 54 are advanced towards the workpiece 18 and the workpiece 18 is machined simultaneously both by the grinding wheel 20 and by the honing pin 54. FIG. 2 illustrates the circular surface grinding machine 10 in a working position in which the honing pin 54 is moved away from the workpiece 18. Moreover, for the sake of clarity, the grinding wheel 20 is not illustrated in FIG. 2.

In order, by means of the circular surface grinding machine then illustrated in FIGS. 1 and 2, to grind a workpiece 18 in such a way that a sharp burr-free circular transition edge is formed between its cylindrical outer face and its conical outer face, the workpiece 18 is first clamped into the workpiece clamping device 16 of the circular surface grinding machine then illustrated in FIGS. 1 and 2 and is driven by means of the workpiece spindle 12 to rotate about the workpiece-spindle axis. In a first grinding operation, then, controlled by the machine control, the grinding wheel 20 rotating about the grinding-wheel axis is advanced towards the workpiece 18 by means of the first advancing device, in such a way that its cylindrical outer face of the workpiece 18 is ground with high accuracy by means of a first profile portion of the grinding wheel 20.

Subsequently, controlled by the machine control, the grinding wheel 20 rotating about the grinding-wheel axis is advanced towards the workpiece 18 by means of the first advancing device, in such a way that the grinding wheel 20 grinds the conical outer face of the workpiece 18 by means of a second profile portion of the grinding wheel 20. At the same time as the grinding of the conical workpiece face, actuated by the machine control, honing pin 54 rotating about the auxiliary-spindle axis is advanced towards the workpiece 18 by means of the second advancing device, in such a way that the honing surface of the honing pin 54 is pressed against the cylindrical outer face of the workpiece 18. The pneumatic drive for moving the auxiliary spindle 56 has previously, during the setting of the circular surface grinding machine 10, been set by an operator in such a way that this drive presses the honing pin 54 against the workpiece 18 with a force of approximately 0.5 to 1 Newton via the auxiliary spindle 56. The honing pin 54 is pressed against the workpiece 18 by means of the second advancing device, in such a way that the honing surface of the honing pin 54, the said honing surface being arranged at right angles to the auxiliary-spindle axis, is arranged in a tangential plane to the cylindrical workpiece face and, in a portion of the cylindrical workpiece face which is contiguous to the transition edge, touches the said workpiece face along a straight contact line. The contact line extends on the honing surface as an uninterrupted line from an outer margin of the honing surface, along a diameter leading through the cylinder axis of the honing pin 54, beyond the cylinder axis to the transition edge. In this case, the honing surface of the honing pin 54 projects in the direction of the contact line away from the cylindrical workpiece face by an amount of approximately 0.2 to 0.3 mm beyond the transition edge. The result of this is that a burr which possibly occurs during the grinding of the conical workpiece face by means of the grinding wheel 20 and which projects beyond the transition edge into the region about the cylindrical workpiece face is immediately removed by the honing pin 54 or by the honing surface of the latter, so that a sharp and burr-free transition edge between the cylindrical and the conical outer face of the workpiece 18 is formed. However, the dimension of the cylindrical outer face, previously already ground with high accuracy, of the workpiece 18 is not appreciably modified as a result of the machining by means of the honing pin 54, since the grinding power delivered by means of the honing pin 54 during the machining or honing of the cylindrical outer face of the workpiece 18 amounts to less than approximately 0.5% of the grinding power which is delivered by the grinding wheel 20 during the grinding of the conical outer face of the workpiece 18.

Controlled by the machine control, at the same time as the termination of the grinding operation for grinding the conical outer face of the workpiece 18 by means of the grinding wheel 20, the honing operation for honing the cylindrical outer face of the workpiece 18 by means of the honing pin 54 is also terminated. This ensures that no burr of any kind is left behind of the transition edge formed between the conical and the cylindrical outer face of the workpiece 18.

The circular surface grinding machine 10 illustrated in FIGS. 1 and 2 is further provided with, for the honing pin, an end-position monitoring device which comprises two end-position sensors. One end-position sensor detects the end position, illustrated in FIG. 1, for the honing pin 54 (honing pin 54 advanced to the workpiece 18). The other end-position sensor detects the end position, illustrated in FIG. 2, of the honing pin 54 (honing pin 54 moved away from the workpiece 18). By means of the end-position monitoring device, when the circular surface grinding machine 10 is operated automatically or semi-automatically, a workpiece change can be prevented when the honing pin 54 is advanced towards the workpiece 18. Moreover, the end-position monitoring device also makes it possible to detect a break of the honing pin 54 and/or a wear of the honing pin 54 such that it has to be exchanged.

Figure 4:
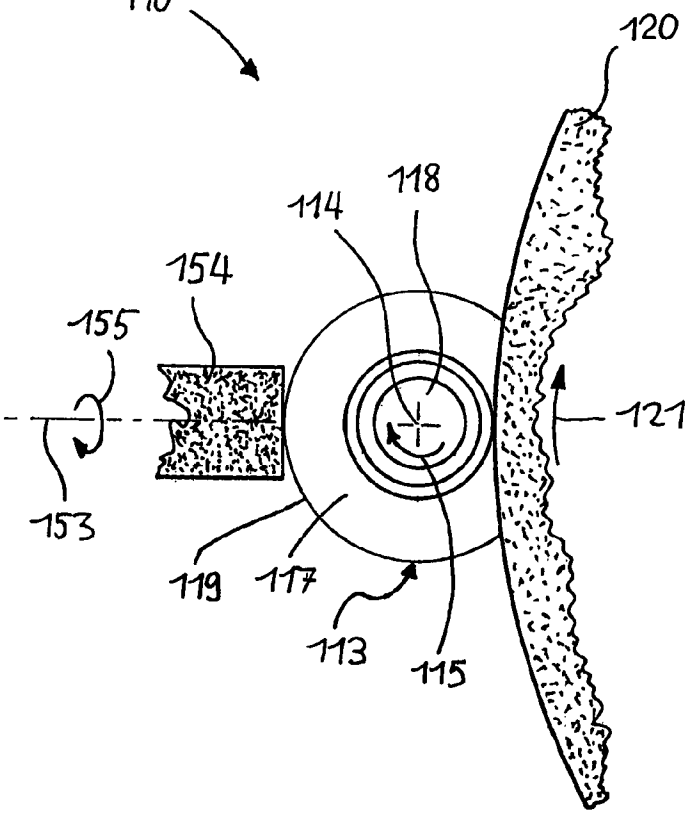
FIG. 4 shows the circular grinding apparatus from FIG. 1 in a simplified diagrammatic part-view from the front.
Figure 3:
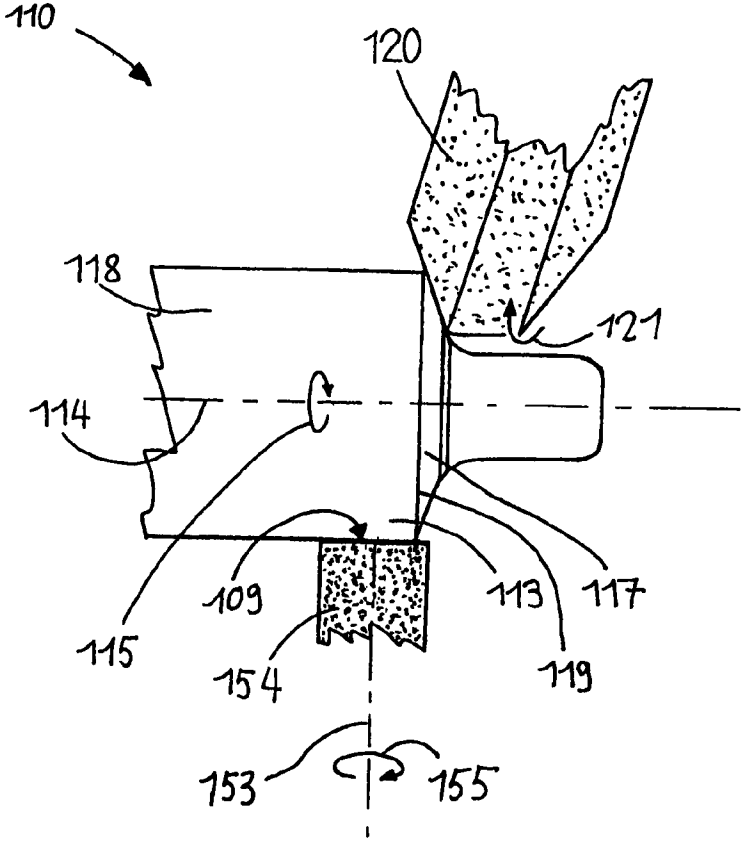
FIG. 3 shows a circular grinding apparatus according to a first preferred embodiment of the invention in a simplified diagrammatic part-view from above.

FIGS. 3 and 4 illustrate in each case part-regions of a grinding wheel 120, of a circular-cylindrical honing pin 154 and of a workpiece 118. The grinding wheel 120 and the honing pin 154 are integral parts of a circular surface grinding machine 110 which is designed according to a second embodiment of the invention. The remaining components of the circular surface grinding machine 110 are not illustrated in FIGS. 3 and 4 for the sake of clarity.

Workpiece 118 illustrated in FIGS. 3 and 4 is designed identically to the workpiece 18 illustrated in FIGS. 1 and 2. It is designed so as to be rotationally symmetrical with respect to a workpiece axis 114 and has a circular-cylindrical outer face 113 and a conical outer face 117 which are arranged adjacently to one another in such a way that the circular transition edge 119 is formed between them.

FIGS. 3 and 4 show the circular surface grinding machine 110 in one working position. In this working position, the workpiece 118 rotates about a workpiece-spindle axis arranged coaxially to the workpiece axis 114, as indicated by the arrow 115 in FIGS. 3 and 4. Moreover, the grinding wheel 120 is advanced towards the conical outer face 117 of the workpiece 118, the grinding wheel 120 rotating about a grinding-wheel axis (not illustrated), as indicated by the arrow 121 in FIGS. 3 and 4. Further, in this working position, the honing pin 154 is also advanced with its honing surface towards the cylindrical outer face 113 of the workpiece 118, the honing pin 154 rotating about an auxiliary-spindle axis 153 coaxial to the cylinder axis of the honing pin 154, as indicated by the arrow 155 in FIGS. 3 and 4. In this case, the honing surface of the honing pin 154 projects in the direction of the contact line 109, formed between the honing surface and the cylindrical workpiece face 113, away from the cylindrical workpiece face by the amount of 10% of the length of the contact line beyond the transition edge 119.

Thus, in the working position of the grinding machine 110, as illustrated in FIGS. 3 and 4, the workpiece 118 is machined simultaneously both by the grinding wheel 120 and by the honing pin 154. In this case, the direction of rotation 115 of the workpiece 118 and the direction of rotation 121 of the grinding wheel 120 are fixed in such a way that the speed of the grinding wheel 120 in the region where the grinding wheel 120 touches the workpiece 118 is directed opposite to the speed of the workpiece 118 as a result of the rotation of the latter about the workpiece-spindle axis in this region. Further, the direction of rotation 155 of the honing pin 154 is fixed in such a way that the honing pin (or the honing surface) has, in the region of the intersection point of the contact line 109 formed between the honing surface and the cylindrical workpiece face 113 with the transition edge 119, a speed component opposite to the direction of the speed of the workpiece 118 in this region.

The circular surface grinding machine 110 in illustrated in FIGS. 3 and 4 differs from the circular surface grinding machine 10 illustrated in FIGS. 1 and 2 essentially only in that the honing pin 154 is not advanced towards the workpiece 118 obliquely from above, but essentially horizontally, so that the honing face of the honing pin 154 presses against the cylindrical outer face 119 of the workpiece 118 essentially from a side facing away from the grinding wheel 120 and opposite to the direction of advance in which the grinding wheel 120 is advanced towards the conical outer face 117 of the workpiece 118. This results in a good stabilization of the workpiece 118 during the grinding operation, and this may contribute to increased precision during grinding.

In a further circular surface grinding machine, not illustrated in the Figures, according to an advantageous variant of the invention, the entire second advancing device, together with the measuring platform plinth, with the pneumatic drive, with the third slide, with the auxiliary spindle and with the honing pin, is arranged on a fourth slide which is movable, parallel to the workpiece-spindle axis (and therefore parallel to the first linear guide), with respect to the first slide along a fourth straight linear guide. The movability of the fourth slide affords the possibility, during a single workpiece chuck-clamping, to carry out a plurality of methods according to the invention one after the other in series, in order to machine a plurality of sharp burr-free transition edges between two adjacent rotationally symmetrical faces of the workpiece in each case.

In summary, it is stated that, by virtue of the invention, a method and an apparatus for circular grinding are specified, which allow a reliable and accurate circular grinding of workpieces with a sharp and burr-free transition edge between two rotationally symmetrical faces, even in the manufacture of large series.

What is claimed is:

1. A method for a circular grinding of a workpiece which has a workpiece axis and, while the method is being carried out, rotates about the workpiece axis, whilst at the same time a grinding wheel rotating about a grinding-wheel axis and the workpiece are advanced towards one another, in order to grind a first workpiece face which is designed to be rotationally symmetrical with respect to the workpiece axis the workpiece further having a second workpiece face which is designed to be rotationally symmetrical with respect to the workpiece axis and which is defined by a rectilinear generatrix, and the two workpiece faces being arranged adjacently to one another in such a way that a circular transition edge is formed between them, wherein, during grinding, an auxiliary abrasive tool, which rotates about an auxiliary-tool axis and has a plane abrasive surface arranged at right angles to the auxiliary-tool axis, is pressed against the workpiece in such a way that the abrasive surface is arranged in a tangential plane to the second workpiece face and touches the second workpiece face along a contact line the abrasive surface projecting in the direction of the contact line away from the second workpiece face beyond the transition edge.

2. The method according to claim 1, wherein the pressing of the auxiliary abrasive tool against the workpiece and the grinding of the first workpiece face are terminated at the same time.

3. An apparatus for a circular grinding of a workpiece, comprising:

a workpiece spindle which rotates about a workpiece-spindle axis and provided with a workpiece holder designed for receiving the workpiece;

a grinding wheel rotating about a grinding-wheel axis;

a first advancing device in order to advance the grinding wheel and the workpiece towards one another;

an auxiliary abrasive tool which rotates about an auxiliary-tool axis and which has a plane abrasive surface arranged at right angles to the auxiliary-tool axis;

a second advancing device for advancing the auxiliary abrasive tool towards the workpiece; and a control device for controlling the apparatus in such a way that, by means of the first advancing device, the grinding wheel and the workpiece are advanced towards one another, in order to grind a first workpiece face in one grinding operation, and in that, during the grinding operation, the auxiliary abrasive tool is advanced towards the workpiece by means of the second advancing device in such a way that the auxiliary abrasive tool presses with its abrasive surface against a second workpiece face, the two workpiece faces being designed to be rotationally symmetrical with respect to the workpiece-spindle axis, and the second workpiece face being defined by a rectilinear generatrix, and the two workpiece faces being arranged adjacently to one another in such a way that a circular transition edge is formed between them, and the abrasive surface being arranged in a tangential plane to the second workpiece face and touching the second workpiece face along a contact line, and the abrasive surface projecting in the direction of the contact line away from the second workpiece face beyond the transition edge.

4. The apparatus according to claim 3, wherein a portion of the auxiliary abrasive tool is of cylindrical design, the abrasive surface being the cylinder base area.

5. The apparatus according to claim 3 wherein the auxiliary abrasive tool is designed in such a way and, while being pressed against the second workpiece face, is arranged in such a way that the contact line on the abrasive surface extends as an uninterrupted line from an outer margin of the abrasive surface, along a diameter leading through the auxiliary-tool axis, beyond the auxiliary-tool axis as far as the transition edge.

6. The apparatus according to claim 5, wherein, while the auxiliary abrasive tool is being pressed against the second workpiece face, the workpiece is made to rotate about the workpiece-spindle axis in such a way and the auxiliary abrasive tool is made to rotate about the auxiliary-tool axis in such a way that the auxiliary abrasive tool has, in the region of the intersection point of the contact line with the transition edge, a speed component opposite to the direction of the speed of the workpiece in this region.

7. The apparatus according to claim 3, wherein the auxiliary abrasive tool includes a honing pin or a precision-grinding stone.

8. The apparatus according to claim 3, further comprising:

a conditioning tool for the conditioning of the abrasive surface.

9. The apparatus according to claim 3, further comprising:

means for selectively setting of force with which the auxiliary abrasive tool presses against the second workpiece face.

10. The apparatus according to claim 3, wherein the auxiliary abrasive tool, while being pressed with the abrasive surface against the second workpiece face, machines the second workpiece face with a substantially lower grinding power than the grinding power with which the grinding wheel at the same time machines the first workpiece face.

11. The apparatus according to claim 3, wherein the auxiliary abrasive tool is arranged on a platform which is movable with respect to the workpiece spindle and which is equipped with at least one measuring instrument.

12. The apparatus according to claim 3, wherein the auxiliary abrasive tool, while being pressed against the second workpiece face, is arranged on a side of the workpiece which faces away from the grinding wheel.

* * * * *